United States Patent [19]

Nakamura et al.

[11] Patent Number: 4,472,955

[45] Date of Patent: Sep. 25, 1984

[54] METAL SHEET FORMING PROCESS WITH HYDRAULIC COUNTERPRESSURE

[75] Inventors: Kazuhiko Nakamura, Chiba; Takeo Nakagawa, Kanagawa, both of Japan

[73] Assignee: Amino Iron Works Co., Ltd., Shizuoka, Japan

[21] Appl. No.: 486,849

[22] Filed: Apr. 20, 1983

[30] Foreign Application Priority Data

Apr. 20, 1982 [JP] Japan ..... 57-66118

[51] Int. Cl.[3] ..... B21D 39/08

[52] U.S. Cl. ..... 72/57; 72/347

[58] Field of Search ..... 72/347, 57, 54, 60; 29/421 R

[56] References Cited

U.S. PATENT DOCUMENTS 3,769,824 11/1973 Granzow ..... 72/57

4,314,468 2/1982 Baril ..... 72/57

4,361,020 11/1982 Hirota et al. ..... 72/57

*Primary Examiner*—Leon Gilden

*Attorney, Agent, or Firm*—Michael J. Striker

[57] ABSTRACT

A punch is pressed on a blankpiece into a die. The die is filled with liquid therein, whereby hydraulic counterpressure is generated by said pressing. The pressed blankpiece is forcibly followed in shape around the punch by hydraulic counterpressure, while part of the hydraulic counterpressure is automatically supplied to an outer circumference of the blankpiece via bypath passage. In case, the blankpiece is a plate, said supplied hydraulic pressure serves as compression force from the outer circumference of the flange to the radius direction. In case, the blankpiece is a product formed by a first drawing, said pressure serves as pressing force toward axial direction of a side wall of the product. When the supplied hydraulic pressure flows out from a space between the punch and a blank holder, the liquid serves as lubrication on an upper and lower surfaces of the blankpiece.

10 Claims, 32 Drawing Figures

METAL SHEET FORMING PROCESS WITH HYDRAULIC COUNTERPRESSURE

BACKGROUND OF THE INVENTION

This invention relates to a metal sheet forming process with hydraulic counterpressure, and more particularly a process where a punch is urged on a blankpiece (called as "material" after) into a die filled with liquid therein, and hydraulic counterpressure generated thereby is utilized to serve as pressing a flange of a material or an axial direction of a side wall of a product.

A deep drawing process is for producing deep cup like products from the plate material, and limit of breakage in the deep drawing process is determined by transmission ability in the side wall of the forming die with respect to shrinkage resistance, bending resistance and friction resistance at the flange portion and the die shoulder portion. Therefore it is necessary for increasing the limit of the breakage to decrease these resistances required to the deep drawing, and increase the available transmission power in the side wall. However an ordinary metal molding process has a limit in the amount of a once drawing formation, though the material to be processed has high drawing quality, and the limit of the drawing ratio is around 2.0 to 2.3 at best.

As a way for increasing the transmission power at the side wall of the drawing device, there is a process which utilizes hydraulic counterpressure. This process, in principle, comprises directly urging the material by means of the punch into a hydraulic pressure chamber which is provided under a die and filled with the liquid, and utilizing the hydraulic pressure generated thereby to cause the material to follow the punch in shape. As actual practices, one is a process which furnishes a packing on an upper surface of the die to contact a lower surface of the material and avoids leakage of the liquid in order to maintain high the hydraulic counterpressure, and the other is a process which does not furnish the packing as said, and presses the material into the die and positively flows out the liquid from the flange so that the liquid is discharged from a releasing space between the die and a blank holder.

Depending upon such a sheet forming process with the hydraulic counterpressure, in the former process the transmission power is increased by friction-keeping-effect in the forming side wall, and especially in the latter process when the liquid is forcibly discharged from the flane, friction-reducing-effect may be provided at the lower face of the blank material. Therefore the limit of the drawing ratio is increased in comparison with the deep drawing process by an ordinary metal mold. Particularly in the latter process, since the friction-reducing-effect is active, the drawing ratio is in general higher than in the former process.

Even if the hydraulic pressure is enough for the friction-keeping-effect in the latter process and since this process pulls the flange portion into a space between the die and the punch, a diameter of the material is large so that the resistance of the flange portion is large accordingly, and then breakage occurs at the die shoulder where the friction-keeping-effect could not exist.

By the latter process, the friction-reducing-effect is only obtained between the material and the die, and fairly large friction resistance exist between the material and the blank holder. Therefore in the conventional drawing with the hydraulic counterpressure, the drawing ratio is around 2.6 to 2.9, and a higher limit of the drawing ratio could not be expected.

The drawing through once process has a certain limit, and therefore when container or vessel of the deep drawing is formed, the drawing work is divided into several steps where the plate is drawn into a product of determined depth (first drawing), and subsequently this product by the first drawing is subjected to several deep drawings (redrawing). In the redrawing process, there are a direct redrawing process and a reverse redrawing process, and a process of incorporating the first drawing and the reverse redrawing is often used, since the number of bendings is lesser by twice if the bending degree is the same. A well known one is a continuous reverse redrawing process which employs a first drawing punch serving also as a redrawing die, a blank holder of cushion type, a first drawing die and a redrawing punch.

However, since such ordinary continuous reverse redrawing process depends upon the metal mold drawing, the drawing ratio is low, that is, limitations are that the redrawing ratio is around 1.3 and the total drawing ratio is around 2.6. For improving these limitations, after the first drawing, the formed product is subjected to an intermediate annealing. Depending upon this process, a product by the redrawing is once taken out from the pressing step, and therefore an entire process is not continuous so that the processing is not efficient. Although the intermediate annealing step intervenes, the improvement is that the redrawing ratio is around 1.8 to the maximum and the total drawing ratio was around 3.5.

SUMMARY OF THE INVENTION

This invention has been devised through many investigations and experiments in order to further improve the sheet forming process with the hydraulic counterpressure as having referred to.

An object of the invention is to provide a novel sheet forming process utilizing the hydraulic counterpressure for largely improving the limit of breakage by means of a simple manner without requiring any special device.

The other object of the invention is to provide a deep drawing process for largely improving ratio without interposing a heat treatment such as the intermediate annealing, which may form products far deeper in height through one pressing step than said intermediate annealing.

For accomplishing these objects the present invention has adopted a process in which the characteristic of the drawing by the counterpressure is effectively used, while the counterpressure is utilized as compression force, the fluid is served as lubrication between the material and the blank holder. Between the die and the blank holder, a ring-like space is defined to make sealing at the outer circumferential area of the blank material. The punch draws the material into the forming die which is the hydraulic pressure chamber, and the counterpressure generated thereby is automatically supplied into the ring-like space via bypath passages. By this pressure, the compression pressure is applied to the outer circumference, while the forming is carried out with the hydraulic counterpressure as making fluid lubrication on both sides of the material. Thus the invention usefully employs the friction-keeping-effect at the side wall portion of the material, and this is one of the characteristics of the bydraulic counterpressure forming process. On the other hand tension force generated in the side wall of the material is reduced by radial pressure, and the friction-reducing-effect may be produced on the both faces of the flanges of the material. Further the compression force is supplied to the outer circumference through the passage communicating the pressure chamber and the ring-like space from the initial period of the process, so that the drawing is assisted by said compression force, and the limit of the drawing ratio is greatly improved by synergistic effect thereof in comparison with the conventional counterpressure drawing process.

In addition to the above mentioned characteristics, the invention usefully employs the hydraulic pressure which is spontaneously generated by pressing the punch in order to directly act the pressure on the outer circumference of the flange via the bypath passage from the pressure chamber. Therefore the invention does not need a special device for supplying the radial pressure nor require high pressure as thousands $Kg/cm^2$, and could obtain the pushing effect to the flange at hundreds $Kg/cm^2$ at best.

The invention undertakes the first drawing in dependence upon the drawing process of the metal mold cushion, and subsequently undertakes the reverse redrawing with the same metal mold in dependence upon the hydraulic counterpressure. The part of the high pressure elevated during the reverse redrawing is supplied to the flange end of the product by the first drawing. When forming containers or vessels deep in height, the material is positioned on the punch and the blank holder of the cushion type and the cushion drawing is performed with the metal molding by means of the blank holder, the first drawing die and the punch. Herein the punch also serves as a redrawing die provided with a hydraulic pressure chamber. The reverse redrawing is undertaken with the hydraulic counterpressure by urging the redrawing punch into the punch which is the hydraulic pressure chamber of the redrawing die. On the other hand, a part of the counterpressure is supplied between the redrawing die and the ring-like space of the first drawing die through the side wall of the redrawing die. Thereby the side wall of the product by the first drawing is pushed into the axial direction thereof, and the lubrication is made on the both surfaces of the side wall and the bottom of the first drawn product, and the reverse redrawing with the counterpressure is continued till the determined depth.

Thus it is no longer necessary to take out the product by the first drawing, i.e., a redrawing material every time from the forming apparatus or interpose the heat treating step such as the intermediate annealing, and possible to efficiently produce the vessels of large depth having the high redrawing ratio and the total drawing ratio.

For providing the friction-keeping-effect and the pushing effect into the side wall, the higher pressure is the more convenient. When the reverse drawing is practised by the hydraulic counterpressure process where the pressure chamber only is filled with the liquid, the upper limit of the hydraulic pressure is delimited in view of strength of the pressure chamber, since the thickness in the side wall of the pressure chamber is determined by redrawing ratio.

In the present invention, the first drawing die composes the side wall of the hydraulic pressure chamber, and the outer diameter of said die may be made large, so that the strength of the chamber is heightened, and accordingly the hydraulic pressure may be heightened. For example, the reverse redrawing on soft steel or stainless steel requires the high pressure up to 500 to 1000 $Kgf/cm^2$ for generating the friction-keeping-effect or said pushing effect. In this regard, the present invention may prepare the strength of the pressure chamber for such high pressure, and produce the vessels of large depth made of the soft steel or stainless steel in one process.

Besides largely increasing of the redrawing ratio as said above, the forming tool is simple in structure, and the hydraulic pressure is utilized which is spontaneously generated by pushing the punch into the pressure chamber, so that the special pressure device is not required for supplying the radial pressure. Thus the invention may be reduced to practice at low cost.

DETAILED DESCRIPTION OF PREFERRED EMBODIMENTS OF THE INVENTION

Figure 3:
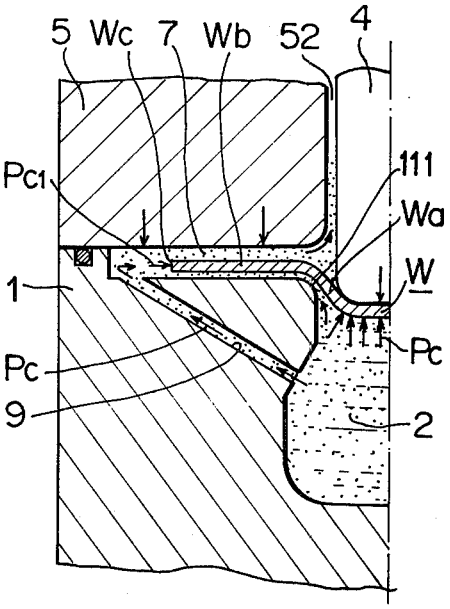
Figure 4:
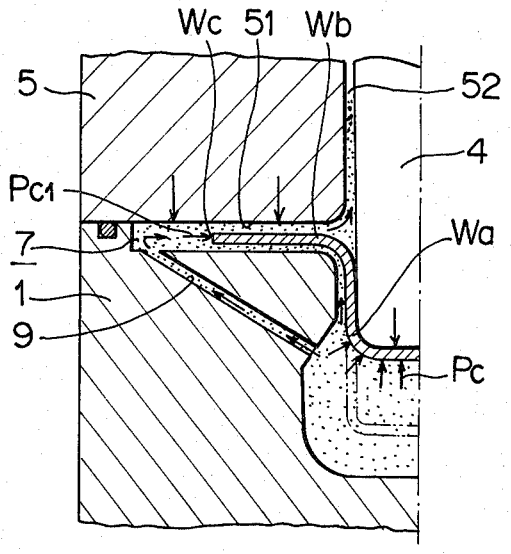
Figure 5:
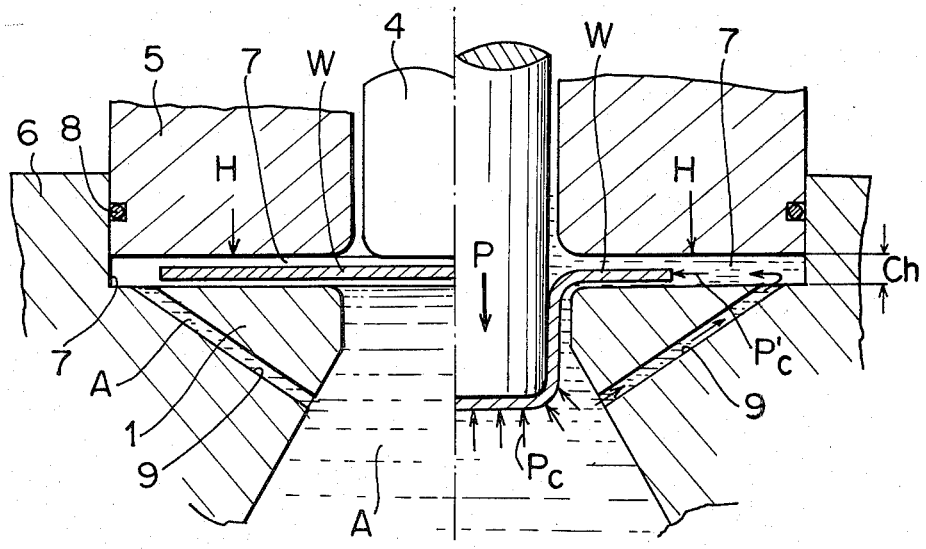
FIG. 5 is a cross sectional view where a blank holder depends upon a pressure blank holding type.

FIGS. 1 to 5 show basic embodiments relating to sheet forming process with hydraulic counterpressure according to the invention, and FIGS. 1 to 4 illustrate a first embodiment of a blank holder of stationary type, and FIG. 5 illustrates a second embodiment of a blank holder of pressure type.

In the embodiments, the numeral 1 is a die, and 2 is a hydraulic pressure chamber which is formed in the die 1 or in a block 3 prepared under the die. 4 is a punch and 5 is a blank holder. In the first embodiment, there is formed a ring-like concave 70 on an upper surface of the die 1, whose inner side communicates with the hydraulic pressure chamber 2 and outer side is closed with a projecting circumferential wall 6 having a seal material 8 to be contacted with the lower surface of the blank holder.

In the second embodiment, a high projecting wall 6 is formed and the blank holder 5 is slidably mounted within the wall 6, whereby the ring-like concave 70 is formed and a sealing material 8 is provided with respect to the blank holder 5.

In each of the embodiments, the outer diameter of the ring-like concave 70 is larger than an outer diameter of a material W to be processed with the deep drawing, and the height h of the concave 70 is made properly larger than at least the thickness of the material W in order to provide a determined ring-like space as later mentioned. A plurality of bypath passages 9 are formed to make communications between the bottom of the ring-like concave 70 and the hydraulic pressure chamber 2. The bypath passage 9 is not necessarily oblique and may be L-shaped. In any way, the passages should be formed in determined diameter and space such that the hydraulic pressure may be uniformly supplied over the circumference of the ring-like concave 70.

Figure 1:
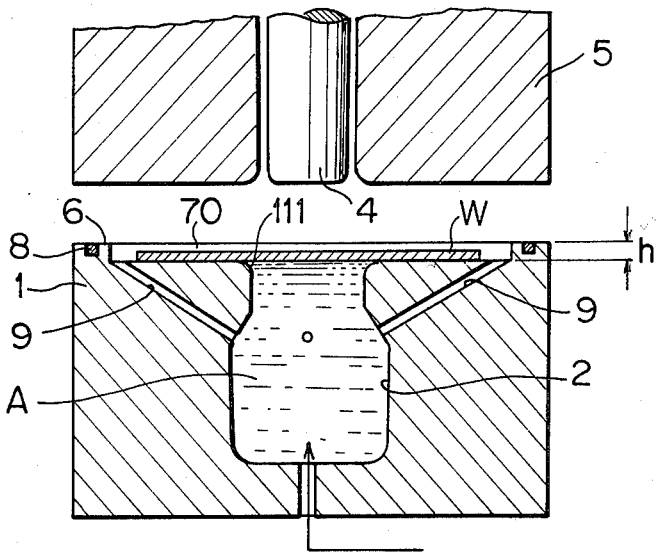
FIGS. 1 to 4 are cross sectional views stepwisely showing basic embodiments of sheet forming process with hydraulic counterpressure.
Figure 2:
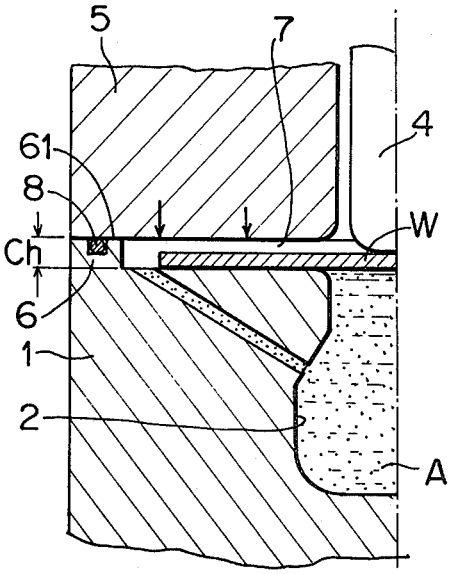

When the deep drawing process is undertaken in the present invention, a liquid A is filled in the hydraulic pressure chamber 2 as shown in FIG. 1, and the material W (plate in this case) is positioned on the concave 70 under condition that the punch 4 and the blank holder 5 are separated from the die 1. Subsequently the blank holder 5 and the punch 4 are moved down. In this way, since the lower face of the blank holder 5 contacts the upper face 61 of the projecting circumferential wall 6 as shown in FIG. 2, the concave 70 is changed into a ring-like space 7 (blank holding space) whose upper side is closed. The material W is idle within the ring-like space 7, and a space is defined between the outer circumferential edge of the material and the the projecting wall. At this time, the liquid A may be filled up to the bottom of the concave 70 as shown, or may be filled up to the upper surface of the concave 70, though not shown. In the latter case, the hydraulic pressure may be generated from the starting of moving down of the punch.

When the punch 4 goes down and urges the material W into the pressure chamber, a counterpressure Pc is spontaneously generated within the pressure chamber 2 as shown in FIG. 3, and the material W is closely contacted thereby to the shoulder of the punch 4 so that the bottom of a vessel starts to grow, and a side wall is gradually made by drawing of the punch 4.

Then since the counterpressure Pc acts to the forming side wall Wa, a friction-keeping-effect could be obtained which is a characteristics of the counterpressure forming process. The counterpressure Pc invades downwardly of the flange Wb of the material passing through space between the die shoulder 111 and the side wall portion, and the fluid lubrication is effected on the lower surface of the material W. The invention is not limited to these effects only. That is, in the invention the bypath passage 9 communicates with the ring-like space 7 and the hydraulic chamber 2. Therefore, the counterpressure Pc is generated by pushing the punch 4 into the die 1, and at the same time the part of the high pressure Pc goes upwardly in the bypath passage 9 and reaches nearly the outer end of the ring-like space 7.

Thereby the hydraulic pressure $Pc_1$ directly acts to the outer circumferential part Wc in the radial direction of the material W as shown in FIG. 3, and the compression force (pushing force) is added to the radius direction from the outer circumference of the material, and the material W is drawn to the determined stroke as shown in FIG. 4 by miving down of the punch 4.

Due to these conditions, the tension strength caused in the side wall is reduced when the deep drawing is carried out. Further as shown in FIG. 4 the hydraulic pressure $Pc_1$ compressing the material W to the radius direction escapes to the upper side of the ring-like space 7, that is, a slight space 51 between the lower surface of the blank holder 5 and the upper surface of the material W, and goes upwardly in a space 52 between the punch 4 and the blank holder 5. Consequently the fluid lubrication effect is also provided between the upper surface of the material W and the lower surface of the blank holder 5. In the counterpressure ordinary forming process, the hydraulic counterpressure generated in the pressure chamber passes between the lower surface of the material W and the upper surface of the die. Therefore the upper surface is not effected with the fluid lubrication. In the present invention, the both surfaces are effected and the friction-reducing-effect is largely provided.

In the first embodiment, the blank holder is stationary. Therefore while the blank holder 5 contacts the die 1 and the drawing by the counterpressure is carried out till the determined forming stroke, the blank holding force of the determined value is effected to the blank holder 5 so that the height of the ring-like space 7, i.e., a blank holding space Ch could be maintained at the determined value. If the blank holding space Ch were too small, the blank holding force would be too stronge and the fluid lubrication by the hydraulic pressure $Pc_1$ would not be smoothly effected so that the friction-reducing-effect would be unsatisfactory. Contrarily, if the blank holding space Ch were too large, the set hydraulic pressure Pc would be decreased so that the breakage easily occurs and wrinkles are formed at the flange parts and those wrinkles would be wrinkles to be formed at the upper part of the side wall of the products. If the blank holding space were within a range between 1.02 and 1.20 $t_0$ in relation with thickness of the material, there would not be reduction of the hydraulic pressure, so that the friction-keeping-effect, flange-pushing-effect and the lubricating effect on both sides may be fully displayed.

In the second embodiment, the blank holder is of pressure type. Therefore it is necessary to control the blank holding force H of the blank holder 5 as increasing of the counterpressure Pc generated by pushing the punch. Only if this pressure system were employed, the space between the material W and the blank holder would be reduced and the hydraulic pressure would be heightened from the starting period, and it is easy to control the ring-like space.

With respect to generation of the counterpressure Pc, the present invention may naturally increase the pressure where the pressure is increased up to a determined level by pushing the punch 4, or forcibly increase the pressure where the pressure is increased by means of a pump or the like before pushing the punch 4. In the latter case since the pressure is initially at the determined value, the friction-keeping-effect or the compression force-adding-effect to the outer circumference of the material may be easily created from the initial period of the process. This is because reverse directional expansion is generated in the material since the hydraulic pressure is high initially, and the upper surface of the material is pressed to the lower surface of the blank holder to create a kind of sealing. When pushing of the punch is begun, the reverse expansion is pushed from the punch to the concave hole of the die, and said sealing is released, and the liquid flows out from the space between the blank holder and the material.

As a manner which causes the hydraulic counterpresssure generated by drawing the material into the hydraulic pressure chamber to act on the outer circumference of the flange, such a process has been considered which simply causes the ring-like space 7 large to supply the counterpressure into the space 7 from between the material W and the die shoulder 111. Depending upon this process it is possible to improve the limit of the drawing ratio in comparison with the conventional drawing process with hydraulic counter pressure. However since the punch 4 is pushed into the chamber 2 and the radial pressure reaches the outer circumference of the flange after the hydraulic pressure has been heightened to a certain extent, there occurs time-lag in pushing operation of the flange, and the thickness at the punch shoulder is largely reduced at the initial period of the forming operation. Therefore the drawing requires high hydraulic pressure, and the limit of the breakage is inevitably lowered than the present invention. In the invention there is not any problem at all since the hydraulic pressure $Pc_1$ for compressing the circumference exists at the outer circumference of the flange simultaneously as generation of the hydraulic counterpressure Pc in the pressure chamber 2.

Figure 6:
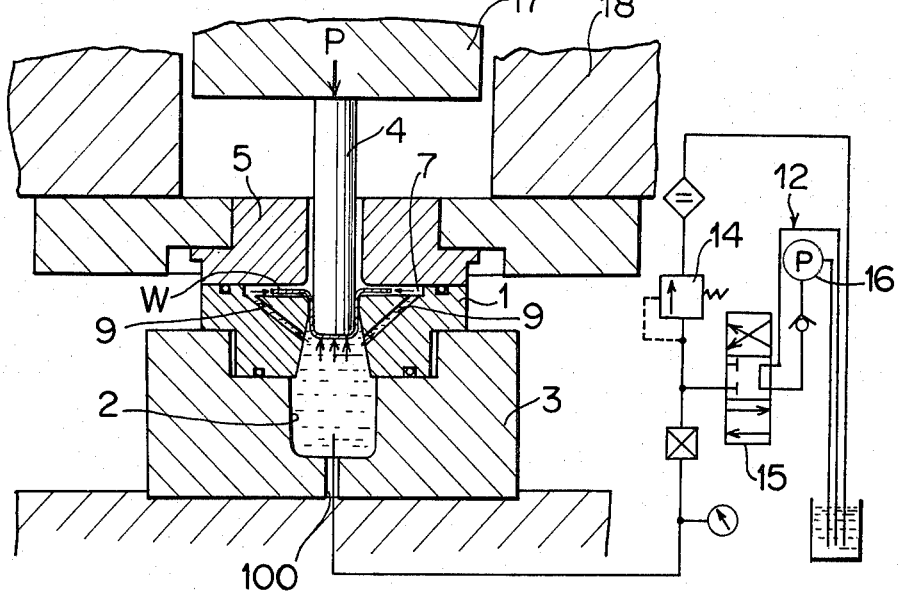
FIG. 6 is a cross sectional view showing one example of an apparatus for practising the sheet forming process utilizing the hydraulic counterpressure according to the invention.
Figure 8:
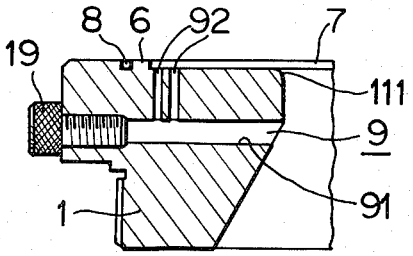
FIG. 8 is a cross sectional view along VIII—VIII, FIG. 9-A is a cross sectional view showing another apparatus for practising another process of the invention, FIG. 9-B is a partially enlarged view of the above.

FIGS. 6 and 8 illustrate one example of the forming apparatus with the deep drawing hydraulic counterpressure. There is installed a dome block 3 under the die 1, which is formed with a deep hydraulic pressure chamber 2 which is connected to an external counterpressure control circuit 12 via a passage 100 running through the bottom. The circuit 12 is merely an example, and a substitution may be used therefor. The punch 4 is contacted with an inner slide 17 and the blank holder 5 is contacted with an outer slide 18.

The die 1 is defined with eight lateral passages 91 equidistantly dividing the circumference under the die shoulder 111. At places near to the outer circumference of the concave 70, vertical passages 92 are formed in communication with the lateral passages 91 per each two passages. These lateral and vertical passages form bypath passages 9 for the radial hydraulic pressure. The numeral 19 is a seal bolt.

Figure 7:
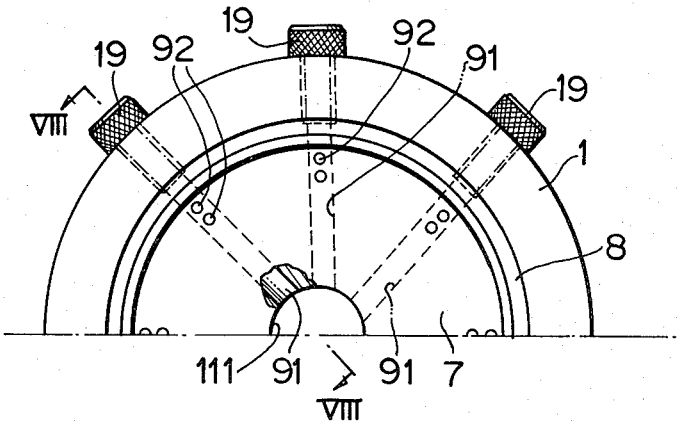
FIG. 7 is a half cross sectional view of the apparatus shown in FIG. 6.
Figure 9A:
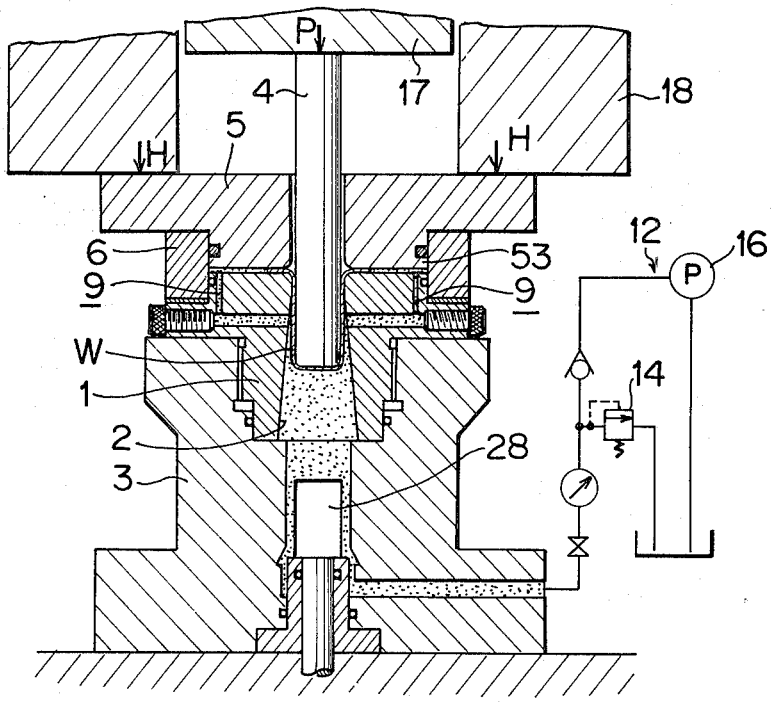
Figure 9B:
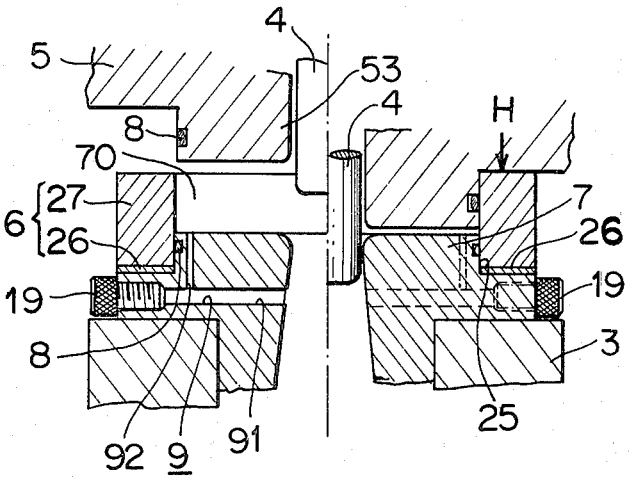

FIGS. 9-A and 9-B show another embodiment to be employed to the practice of the invention. In FIGS. 6 to 8, the die 1 is formed with the projecting circumferential wall 6 whereby the concave 70 is provided. On the other hand, in the embodiment shown in FIG. 9, the head of the die 1 is formed flat, and L-shaped step 25 is formed at the corner of the upper portion on which a spacer ring 26 and a seal block 27 are mounted to form projecting circumferential wall 6 and a ring-like concave 70. The blank holder 5 is formed with a projection 53 on the inner diameter surface of the seal block 27, and a sealing material 8 is provided on the circumferential surfaces of the projection 53 and the step 25. In this embodiment, spacer rings 26 of different thicknesses are prepared, and they are exchanged so that the blank holding space Ch may be set optionally. The numeral 28 is a knock-out. The basic structure of the invention is as having mentioned above, but may of course include other processes such as under said.

Figure 10:
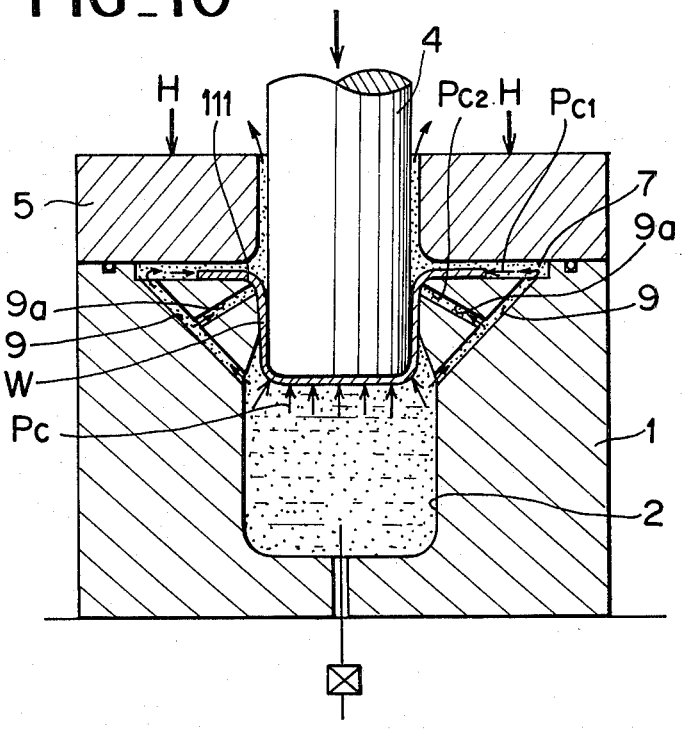
FIG. 10 is a cross sectional view showing an example where the invention is applied to an ironing deep drawing process.

FIG. 10 shows an ironing deep drawing process as one example. In this process, the punch 4 and the die hole are structured in diameter such that determined ironing ratio is obtained. The ring-like space 7 is formed between the die 2 and the blank holder 5, and the material W is drawn into the hydraulic pressure chamber 2, taking the ironing component into consideration. The part of the counterpressure Pc generated by said drawing is supplied into the space 7 via the bypath passage 9 running from the pressure chamber 2 and the compression force $Pc_1$ is added to the radius direction from the outer circumference of the material W. In the instant process, there has been in advance provided the bypath passages 9 between the hydraulic pressure chamber 2 and the die shoulder 111, and the hydraulic pressure $Pc_2$ is supplied to the die shoulder 111 at the same time as said addition of the compression force $Pc_1$, thereby to effect the lubrication on the die shoulder. By this process, further deep vessels may be realized. The blank holding manner may rely on any of the stationary or pressure system.

Figure 11:
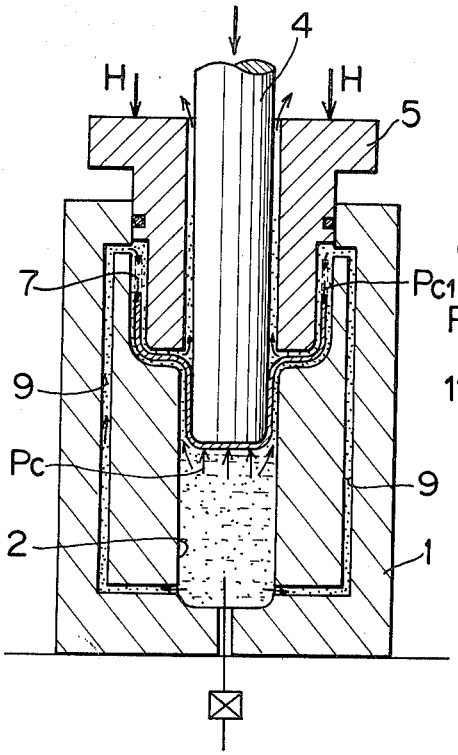
FIG. 11 is a cross sectional view showing an example where the invention directly applied to a redrawing process.

A further embodiment is the redrawing process as shown in FIG. 11. The redrawing is applied to a vessel of square body, a vessel of small bottom or large depth. If the invention is applied to the redrawing, the formability is made excellent. The material W of cup shape is obtained by the first drawing in dependence upon the invented or other process, and the cup shaped material W is set on the die 1 for performing the redrawing. For this performance the blank holder 5 is defined with the ring-like concave on its outer circumference, and the bypath passages 9 are prepared between the hydraulic pressure chamber 2 and the upper inside surface of the die 1. The material W is mounted and the blank holder 5 is pressed into the die 1, whereby longitudinal ring-like space 7 is formed on the outer circumference (region including an upper end of the side wall) of the material W. When the punch 4 is moved down to redraw the material, the part of the hydraulic counterpressure Pc generated in the pressure chamber 2 is supplied into the ring-like space 7 from each of the passages 9. Thus, while the upper end of the side wall of the material is compressed downwardly to the pressure chamber, the both surfaces of the material are provided with lubrication.

Figure 12:
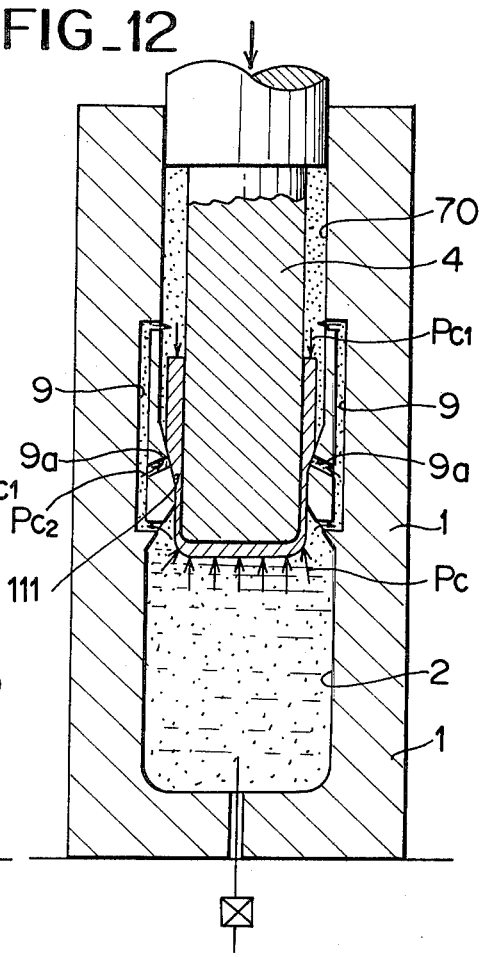
FIG. 12 is a cross sectional view showing an example where the invention is applied to an ironing process.

FIG. 12 shows an application of the invention to the ironing pressure process. In the instant process, an ironing punch 4 is formed on an outer circumference with the ring-like concave. The bypath passages 9, 9*a* combine the hydraulic chamber 2—the concave 70—the die shoulder 111, and the ironing is performed with the counterpressure by means of the punch 4 and the die shoulder 111. At the same time, the part of the counterpressure Pc in the chamber 2 is supplied to the outer and upper portion of the material W and the die shoulder 111, respectively, so that the die shoulder 111 is give the lubrication while the material W is pressed toward the die shoulder. By this process, the limit of the ironing process may be largely heightened.

Figure 17:
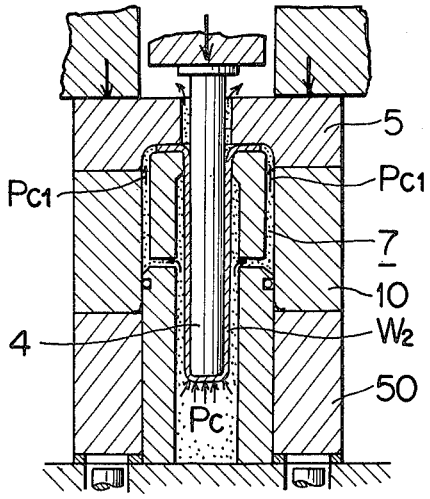
FIGS. 13 to 17 are cross sectional views stepwisely showing embodiments where the invention is applied to the reverse redrawing process to form vessels of deep bottom through one process,-
Figure 13:
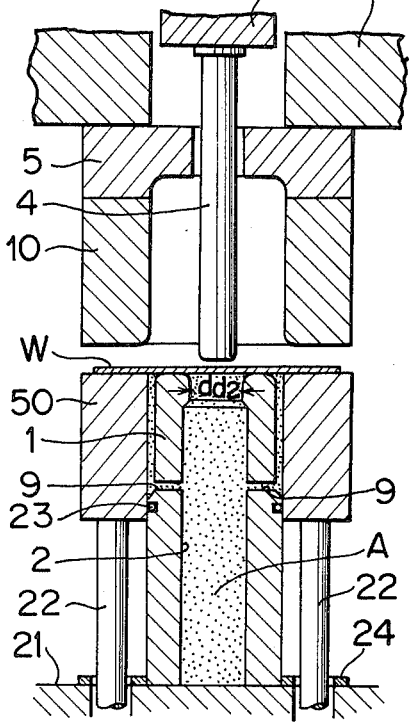
Figure 18:
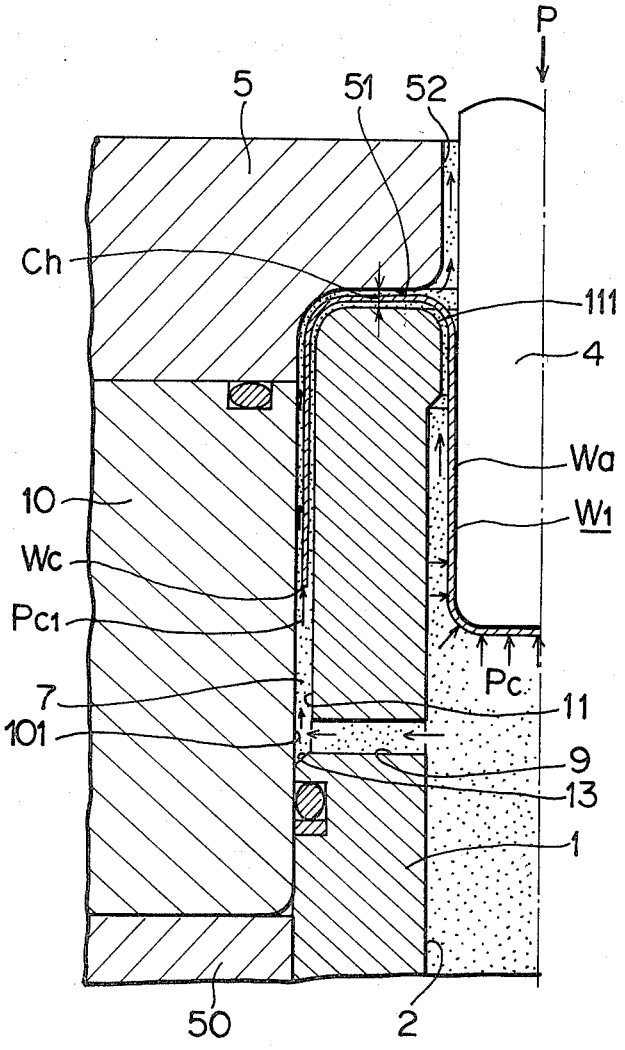
FIG. 18 is a half cross sectional view showing supply of radial hydraulic pressure in the redrawing step.

FIGS. 13 and 18 show embodiments where the present invention is applied to the reverse redrawing. In the embodiment shown in FIG. 11 the first drawing is carried out with the other apparatus, and the product by the first drawing is taken out from the apparatus and mounted on the apparatus shown in FIG. 11 for subjecting to the redrawing by the hydraulic counterpressure. On the other hand, the embodiment shown in FIG. 13 through FIG. 18 is characterized by performing the first drawing and the counterpressure redrawing in one continuous process.

Figure 15:
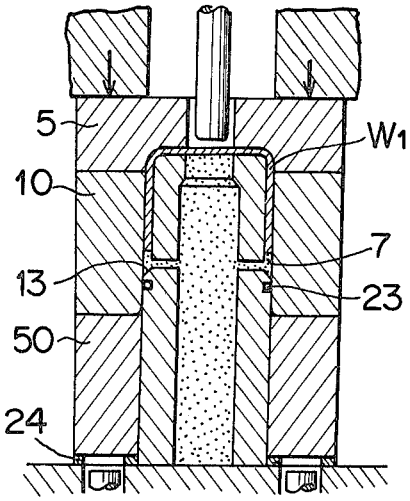
Figure 16:
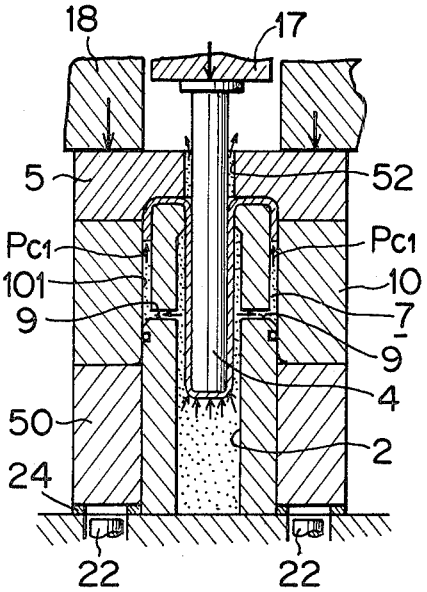

The forming process of vessels deep in height with the radial counterpressure reverse redrawing, comprises basically the first drawing (drawing of plate) by the ordinary drawing of the metal molding cushion type (FIGS. 13 to 15) and the counterpressure reverse drawing by additing the hydraulic pressure to the radius direction (FIGS. 16 and 17).

The first drawing is carried out with a first drawing die 10 provided to an outer slide 18, a first drawing blank holder 50 on a cushion pin 22 passing through the bed 21, and the punch 1 (serving also as the redrawing die) fixed on the bed 21. The reverse redrawing is carried out with a redrawing punch 4 provided on an inner slide 17, a redrawing blank holder 5 integrally or independently fixed to said first drawing die 10, and the hydraulic pressure chamber 2 formed within the punch 1.

For adding the radial pressure during the redrawing, the invention provides, in the side wall of the punch, a plurality of the bypath passages 9,9 making communications with the hydraulic pressure chamber 2 and the end portion of the punch, and furnishes a sealing packing 23 on the outer circumference of the punch under the bypath passages 9,9.

The vessel of deep bottom is formed by elevating the cushion pin as shown in FIG. 13, elevating the blank holder 50 up to a level meeting the upper surface of the punch 1 at the holding surface, and supplying the liquid A such as oil into the hydraulic chamber 2. The liquid A passes through the bypath passages 9,9 and fills a tubular space defined between the inner diameter part of the blank holder 50 and the outer part of the punch 1.

Figure 14:
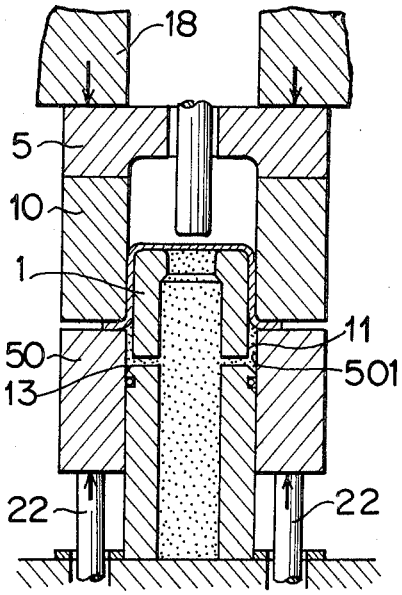

Subsequently the material W is mounted on the blank holder 50 and the punch 1, and the outer slide 18 is moved down so that the material M is held between the die 10 and the holder 50. The blank holding force is supplied via the cushion pin 22 and the first drawing die 10 is moved down to carry out the cushion drawing. The material W is followed in shape around the punch 1 by moving down the first drawing die 10 and is drawn into the first drawing die as shown in FIG. 14. When the blank holder 50 goes down till the lower limit as shown in FIG. 15, the material W turns out a product W1 by the first drawn of cup shape without flange.

The liquid filled in the pressure chamber of the punch 1 and the space between the outer side of the punch and the inner side 501 of the blank holder 50, is sealed by contacting of the seal packing 23 provided on the outer side of the punch and the inner side of the blank holder and the blank holding force acting to the first drawing die 10 and the blank holder 50. When the first drawing is completed, the liquid A is sealed in the ring like space defined by the inner side 101 of the first drawing die 10, the outer side 11 of the punch and the step 13 of the punch.

The reverse redrawing is undertaken under a condition that the product W1 obtained by the previous process is positioned between the first drawing die 10 and the punch 1. In other words, firstly the outer slide 18 adds the pressure to the bottom of the first drawing die 10 or the redrawing blank holder 5 as a substitution of said bottom in order to cause the blank holding force required to the reverse redrawing between the upper surface of the punch 1 and the die 10. Subsequently the redrawing punch 4 is moved down by the inner slide 17 into the hydraulic pressure passing through the bottom of the first drawing die 10 or the central hole 52 of the redrawing blank holder 5, and the reverse redrawing is begun with the hydraulic counterpressure.

The liquid in the chamber 2 is effected with pressure increasing by pushing the redrawing punch 4, whereby the hydraulic counterpressure is generated. By this counterpressure Pc, the bottom of the first drawn product W1 is followed in shape around the shoulder of the redrawing punch 4 as shown in FIGS. 16 and 18, and a side wall Wa is formed by pushing the redrawing punch 4.

The part of the pressure heightened fluid flows into space between the material and the shoulder 111 of the punch 1 (herein the redrawing die), and the lubrication is made on the inner side of the side wall of the first drawn product W1 and the inner side of the bottom. The ordinary counterpressure drawing is limited thereto. In the invention, the bypath passage 9 communicates with the space defined between the outer circumference of the punch 11 and the pressure chamber 2. Therefore the part $Pc_1$ of the counterpressure by pushing of the redrawing punch 4 is flown under pressure into the space 7 from the bypath passage 9 as shown in FIG. 18. This radial pressure $Pc_1$ directly acts to the side wall of the product W1 and presses the end Wc of the side wall to the axial direction. The radial pressure $Pc_1$ passes the outer side of the wall of the product W1 and the outer side of the bottom, and discharges upwardly from a space 52 formed with the redrawing punch 4 and the bottom of the first drawing die or the wall of the redrawing blank holder 5. During this period the lubrication is made on the outer side of the wall of the product W1 and the outer side of the bottom.

As said the invention carries out the reverse redrawing with the hydraulic counterpressure so that the friction-keeping-effect is provided on the shoulder of the punch and the side wall, and the part of the counterpressure is supplied into the space 7 between the punch 1 and the first drawing die 10. Thus the side wall of the product W1 is positively pushed to the axial direction. Therefore tension is reduced which is generated in the side wall of the product of the first drawing when the reverse redrawing is performed. Simultaneously the fluid lubrication is effectively made on the side wall of the first drawn product and the bottom, and the redrawing ratio is largely increased by the synergestic effect thereby, and the vessel W2 of deep depth as shown in FIG. 17 is formed in one forming process.

The pressure pressing manner in the hydraulic pressure chamber 2 in said reverse redrawing may depend as shown in FIGS. 16 and 17 on natural pressure increasing by pushing of the redrawing punch 4. If the pressure were not enough with pushing of the punch at the initial period of the procedure, the pressure chamber 2 would be forcibly increased with pressure by the pump 16 when the first drawing is finished (a condition shown in FIG. 15) and the punch would be forcibly pushed.

The blank holding manner in the reverse redrawing may be depend upon any of a stationary system or a pressure system. In the present embodiment, a spacer 24 intervenes between the bed 21 and the blank holder 5*a*, and the stationary blank holder system is employed. The spacer 24 may be ring-like shape formed with a hole for passing the cushion pin 22, or may be such a type that a spacer without hole is secured with bolts under the first drawing blank holder 50 and is upheaved by the cushion pin 22 together with the blank holder 50. When depending upon the pressure blank holder, the spacer 24 is removed and the blank holding pressure by the outer slide 18 is controlled as increasing of the hydraulic pressure in the chamber 2.

If the blank holding space Ch (a clearance between the bottom of the first drawing die or the lower surface of the redrawing blank holder 5 and the upper surface of the punch 1) were too small, the blank holding force would be too strong and the fluid lubrication by the hydraulic pressure $Pc_1$ would not be smoothly effected and the limit of the breakage would be lowered. Contrarily, if the blank holding space Ch were too large unnecessarily, the hydraulic pressure from the set hydraulic pressure would be decreased so that the limit of the breakage is lowered due to lacking of the pressure. Through the inventors' investigations if the blank holding space Ch were 1.00 to 1.20 $t_0$ the friction-keeping-effect+the pushing-effect to the side wall+the lubricating effect on both surfaces were fully displayed. The lower limit of 1.00 $t_0$ is because the thickness is decreased somewhat and the substantial space is around 1.05 $t_0$.

Figure 19:
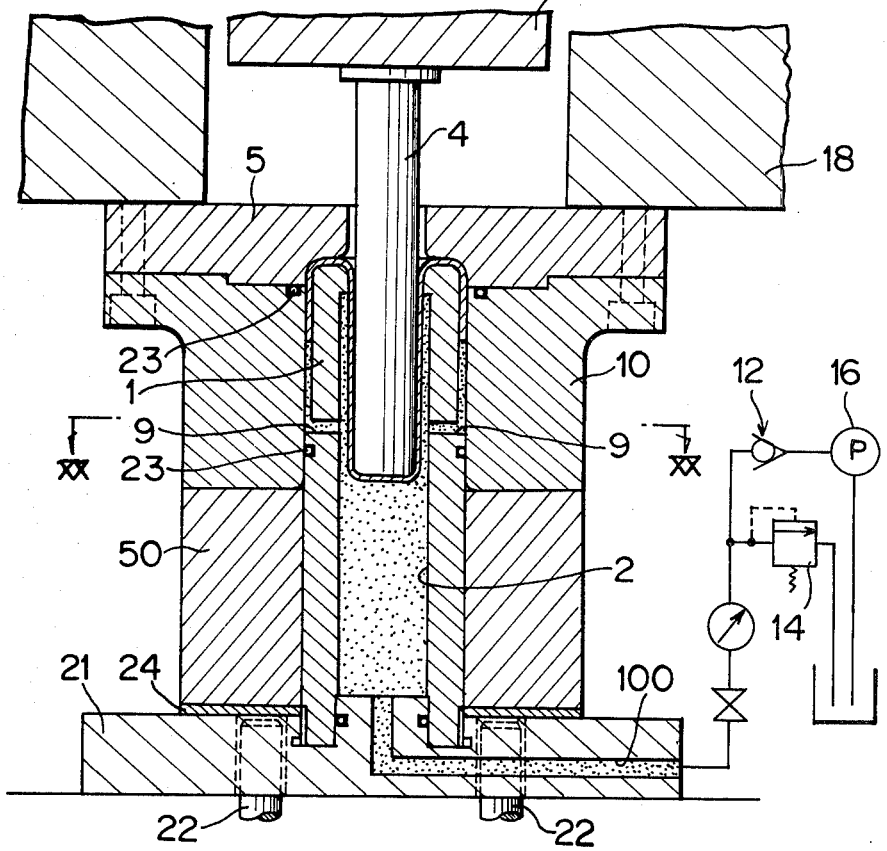
FIG. 19 is a vertical plane view showing an example of the apparatus to be practised by the invention.
Figure 20:
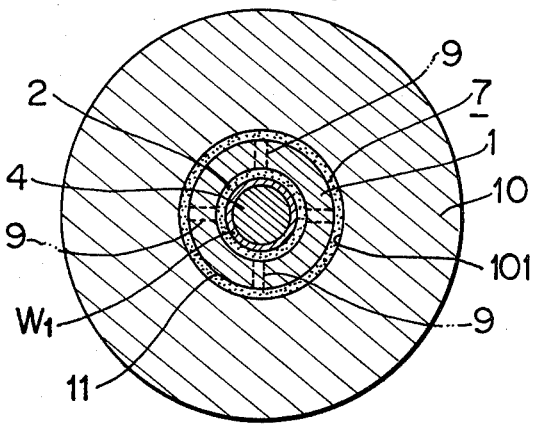
FIG. 20 is a cross sectional view along XX—XX in FIG. 19.

FIGS. 19 and 20 show an embodiment where a double-acting press with cushion is provided with the forming tool for practising the invented process. The bottom of the pressure chamber 2 is formed with a passage 100 running through a bed 21, which communicates with an external hydraulic control apparatus 12. The hydraulic pressure control apparatus 12 is only enough with a pump 16 for feeding the liquid into the chamber 2 and a control valve 14 for setting the hydraulic pressure at the determined value. Therefore the embodiment is not limited to the shown one. In the instant the redrawing blank holder 5 is secured on the first drawing die 10 and a seal packing material 23 is positioned therebetween, and a stationary blank holding spacer 24 is provided under the blank holder 50.

EXAMPLE 1

I The deep drawing process with the hydraulic counterpressure was carried out by the invention with the apparatus shown in FIG. 6 and the die shown in FIGS. 7 and 8.

(1) Conditions of the tool

Diameter dp of punch: 30.0 mmϕ

Radius rp of punch shoulder: 5 mm

Diameter dp of hole of die: 32.4 mmϕ

Radius rd of die shoulder: 5 mm

Concave of die: 120 mmϕ in diameter and 0.83 mm in depth

Press: double-acting oil press (inner: 30 ton and outer: 15 ton) The hydraulic pressure was naturally heightened by pushing the punch, and the experiment was made at the maximum hydraulic pressure 420 Kg/cm$^2$ under the condition that the pressure was constant at the set pressure of the releaf valve. Liquid for counterpressure: acting oil.

(2) Material: Aluminium plate (A 1100-0) of 0.8 mm thickness Mechanical properties: as under table

| | T.S. (Kg/mm$^2$) | P.S. (Kg/mm$^2$) | Total Elongation (%) | n | $\bar{n}$ | r | $\bar{r}$ |
|---|---|---|---|---|---|---|---|
| 0° | 10.1 | 4.4 | 38.1 | 0.24 | | 0.63 | |
| 45° | 9.7 | 4.3 | 43.7 | 0.25 | 0.25 | 0.91 | 0.82 |
| 90° | 10.0 | 4.3 | 40.7 | 0.25 | | 0.84 | |

Figure 21:
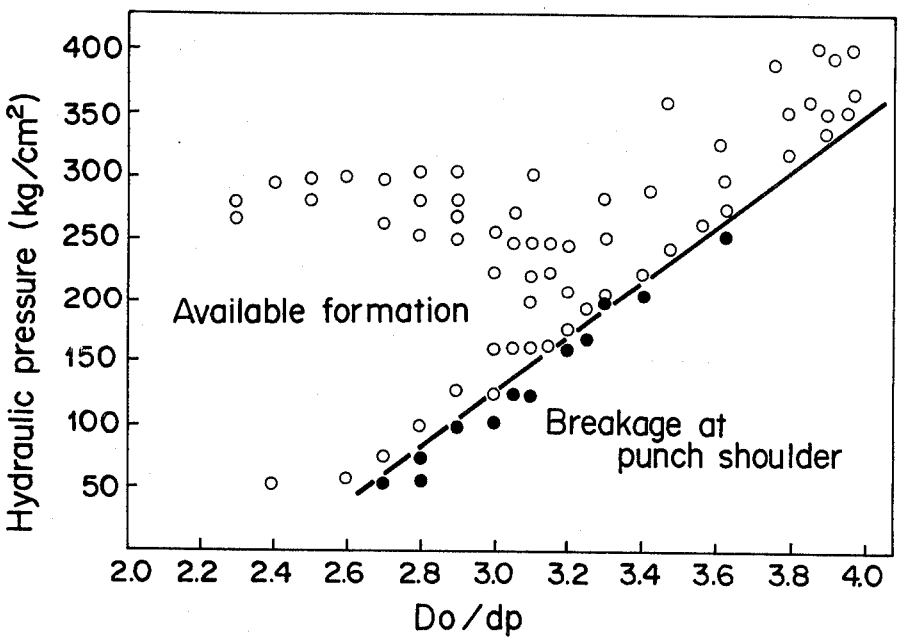
FIG. 21 is a graph showing a forming condition by the invention.

II FIG. 21 shows the forming condition by the invention when the set pressure of the releaf valve is varied in each of the drawing ratios. As is seen from FIG. 21, in addition to the characteristics of the hydraulic counterpressure, the limit of the drawing ratio was 3.2 at the set pressure of 175 Kg/cm$^2$, and 4.0 at the set pressure of 400 Kg/cm$^2$ by the flange pushing by the counterpressure to the radial direction and by the lubricating effects on the both surfaces of the flange.

Figure 22:
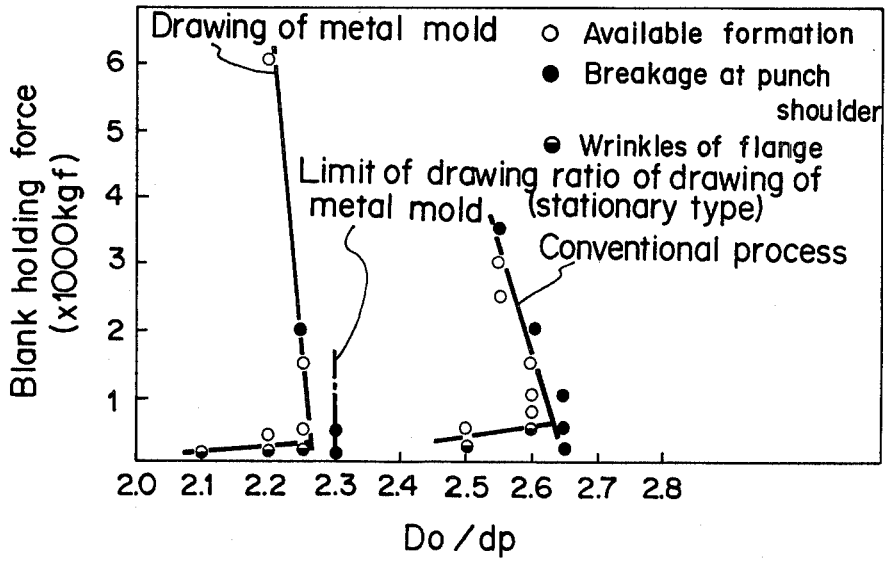
FIG. 22 is a graph showing forming conditions of an ordinary metal molding process and a conventional hydraulic counterpressure.

III The effects by the invention were evaluated by carrying out the deep drawings in the constant-pressure blank holding process, the ordinary metal molding process by the stationary blank holding process, and the hydraulic counterpressure process flowing the fluid from the blank holding spaces where the outer circumference was released (called as "conventional process" after). The conditions of the material, the tools and the press were the same as above. The results of the experiments are shown in FIG. 22.

With respect to the limit of the drawing ratio, it is 2.25 in the constant-pressure process, and 2.30 in the stationary process, while the conventional process shows 2.63. This effect is due to the fluid lubricating effect on the lower surface of the material and the friction-keeping-effect on the side wall. However this value is lower than the invention.

Figure 31:
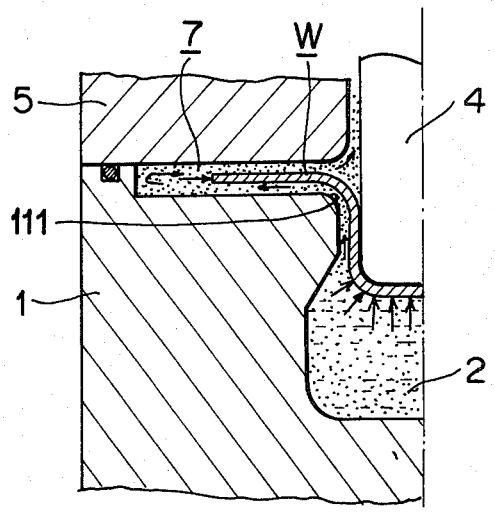
FIG. 31 is a cross sectional view of a case supplying the radial pressure into a ring like space from a die shoulder without providing bypath passages.
Figure 23:
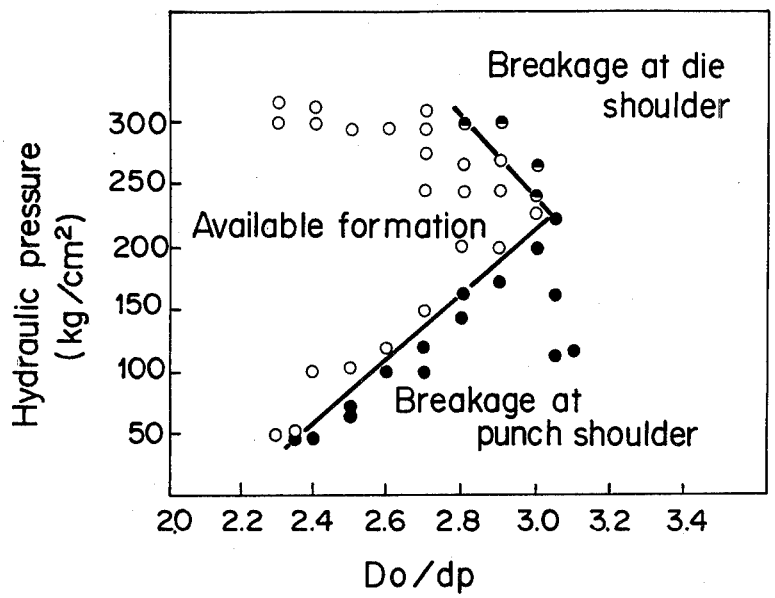
FIG. 23 is a graph showing a forming condition depending upon a radial pressure supplying process (comparative process)
Figure 24:
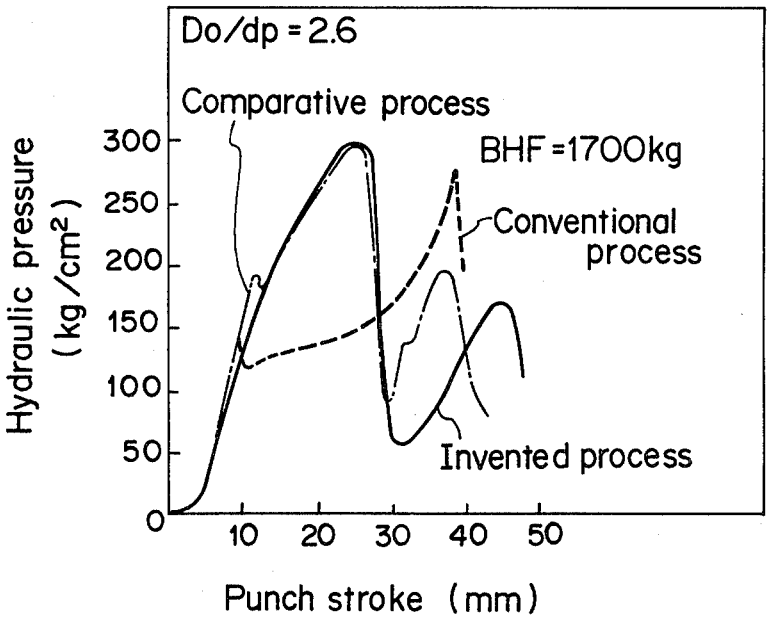
FIG. 24 is hydraulic pressure—punch stroke in regard to the drawing ratio of 2.6 of the invented process, the conventional process and the comparative process.
Figure 25:
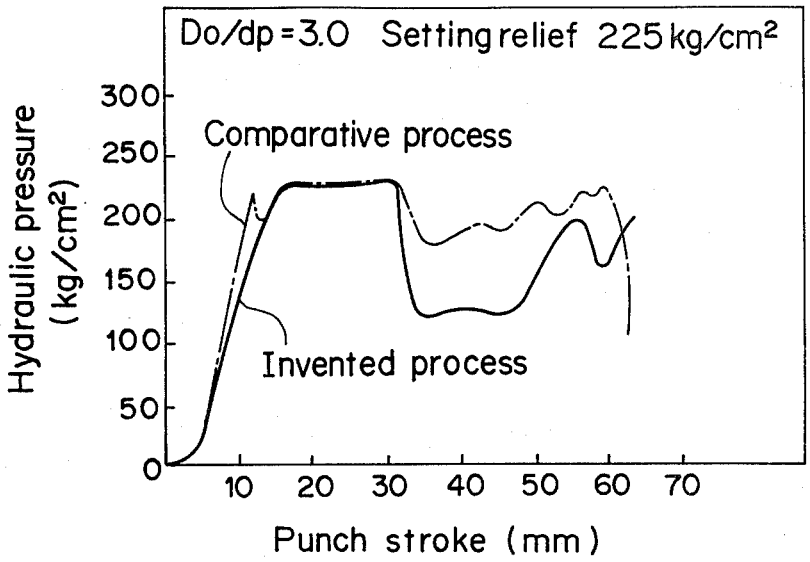
FIG. 25 is hydraulic pressure—punch stroke in regard to the drawing ratio of 3.0 of the invented process and the comparative process.

IV The effect by the mechanism supplying the radial pressure was evaluated by carrying out the drawing by the hydraulic counterpressure process flowing the liquid from between the material and the die (FIG. 31). The results are shown in FIG. 23. The forming available region is narrow, and the hydraulic pressure is high in comparison with the invention, and the limit of the drawing ratio is 3.0 at the set pressure of 230 Kg/cm$^3$. The hydraulic-stroke diagrams in the comparative process and the invented process are shown in FIGS. 24 and 25. FIG. 24 shows that the drawing ratio (Do/dp) is 2.6 and FIG. 25 shows that the drawing ratio is 3.0. FIG. 24 also shows the hydraulic pressure-stroke diagram by the conventional process. As is seen from these diagrams, the comparative process shows that the hydraulic pressure increases in the same obliquity as the hydraulic counterpressure drawing by pushing the punch, and it decreases temporally when the fluid flows out between the material and the die and reaches the outer circumference of the flange, and subsequently it further increases as pushing the outer circumference of the flange to the radial direction, and largely decreases when the fluid flows out from between the material and the blank holder.

In the invented process, since the liquid exists at the outer circumference of the flange simultaneously as pushing the punch, the pressure is not decreased when the fluid flows from the material and the die, but the pressure is increased from the initial period of the procedure as pushing the outer circumference of the flange, and the pressure is largely decreased when the liquid flows out from between the material and the blank holder.

From the above mentioned matter, it is seen that the comparative process is involved with the time-lag in the flange pushing effect, while the present invention has the flange pushing effect from the starting period of the forming process and therefore the thickness of the material is controlled at the shoulder of the punch so that the limit of breakage is improved, and the invented process is more excellent than the comparative process.

EXAMPLE 2

I The vessel of deep depth was obtained through the reverse redrawing process by the invention with the experimental apparatus shown in FIGS. 19 and 20.

(1) Press: double-acting oil press with cushin (inner: 80 ton, outer: 50 ton and cushion: 50 ton)

(2) Material: same as in (2) of EXAMPLE 1

(3) Conditions of first drawing are as under

Diameter of punch: $dp_1=75$ mmϕ

Diameter of hole of first drawing die: $d_{d1}$: 77 mmϕ

Radius of punch shoulder: $rp_1=R6$

Radius of shoulder of first drawing die: $rd_1=R5$

Lubricant: high viscosity oil

Blank holding force: 10,000 Kgf

Variations of the drawing ratio ($Do/dp_1$) were made by varying the diameter of the material under the condition that the tool was constant.

(4) The reverse redrawings were carried out under the conditions as follows. The redrawing ratio was varied in that $dp_1$ and $d_{d1}$ were constant, and $dp_2$ and $d_{d2}$ were varied.

Diameter of redrawing punch: $dp_2=30$, 32, 34, 36 mmϕ

Diameter of die hole (diameter at first drawing): $d_{d2}=32$, 34, 36, 38 mmϕ

Depth of die hole: 215 mm

Diameter of shoulder of redrawing punch: $rp_2=R5$

Radius of die shoulder: $rd_2=R5$

Length of redrawing punch: 200 mm (substantially 175 mm)

Blank holding type: stationary blank holder

Pressure increasing manner: forcibly increasing

Fluid for hydraulic counterpressure: working oil

Bypath passage: 4 axially symmetrical positions, 6 mmϕ diameter.

Figure 26:
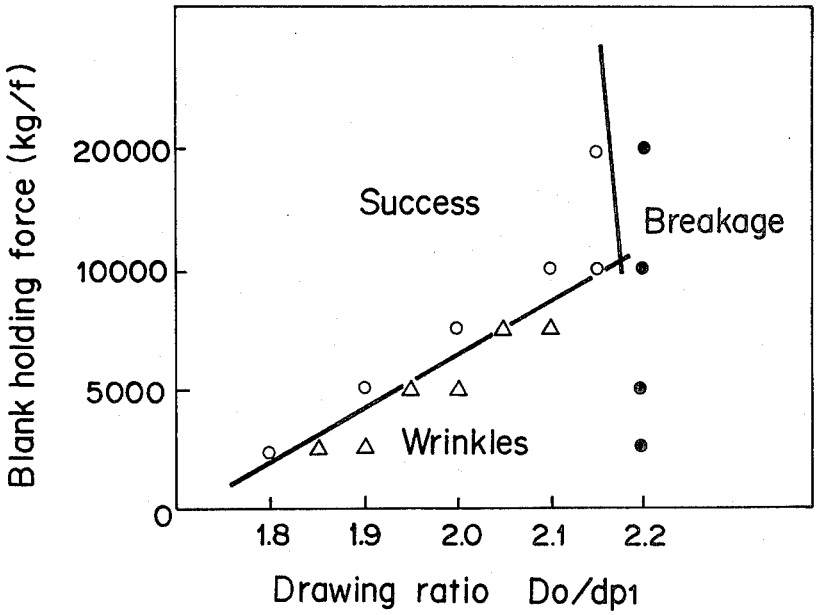
FIG. 26 is a graph showing a forming condition of a first drawing process in FIGS. 13 to 17, FIGS. 27 and 28 are graphs showing forming conditions in a reverse redrawing process in the invention.

II The first drawing was performed under the conditions said in (3) of the item I, and the forming circumstances are as shown in FIG. 26. The first drawing-reverse redrawing of adding the radial pressure was practised by the present invention at the first drawing ratio $Do/dp_1$ of 1.8 to 2.15 within the success range, the redrawing ratio $dp_1/dp_2$ of 2.34 and the blank holding space Ch (ring-like space) of 1.20 $t_0$. The forming circumstances are as in FIG. 27. FIG. 28 shows the forming circumstances under the conditions that the redrawing ratio $dp_1/dp_2$ was 2.5 and the blank holding space Ch was 1.15.

Figure 27:
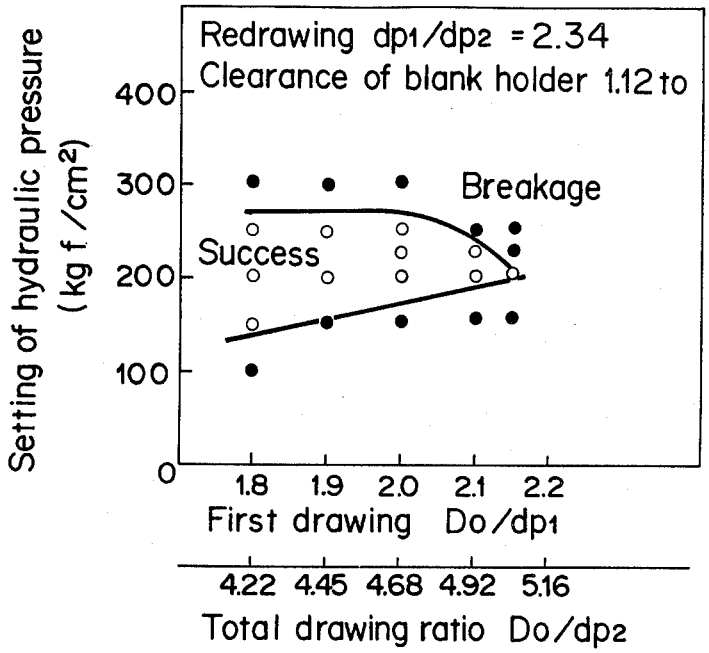
Figure 28:
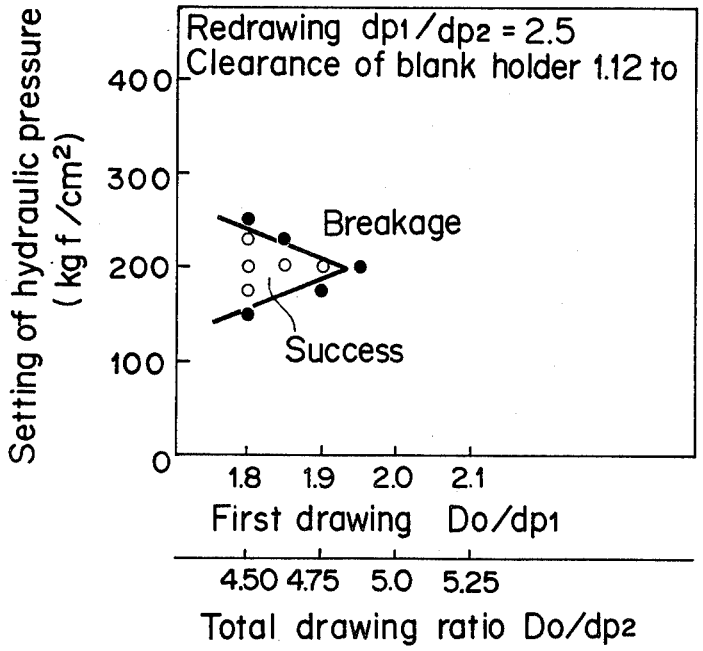

As is seen from FIGS. 27 and 28, depending upon the present invention, the redrawing ratio $dp_1/dp_2$ is considerably improved in comparison with around 1.3 of the conventional process, and the total drawing ratio $Do/dp_2$ is improved up to above 4.9 in comparison with around 2.6 at the maximum of the conventional process. In the present embodiment, since the diameter of the minimum redrawing punch was 30 mmϕ and the diameter of the die hole was 32 mmϕ, the redrawing ratio was around 2.5 and the total drawing ratio was around 4.9. But if said diameters were smaller, the redrawing ratio would be around 2.6 and the total drawign ratio would be around 5.3.

III The effect of adding the radial pressure by the invention was confirmed in that the hydraulic counterpressure reverse redrawing process (comparative process) was undertaken under the same condition as (4) of the item 1 with the constant-pressure blank holder but without the bypath passage.

Figure 29:
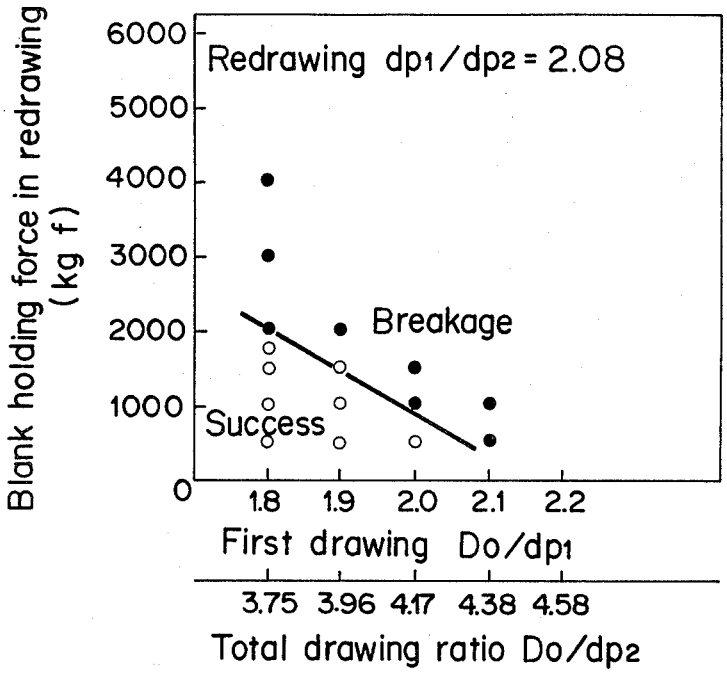
FIGS. 29 and 30 are graphs showing forming conditions in the reverse redrawing with hydraulic counterpressure without using radial pressure.
Figure 30:
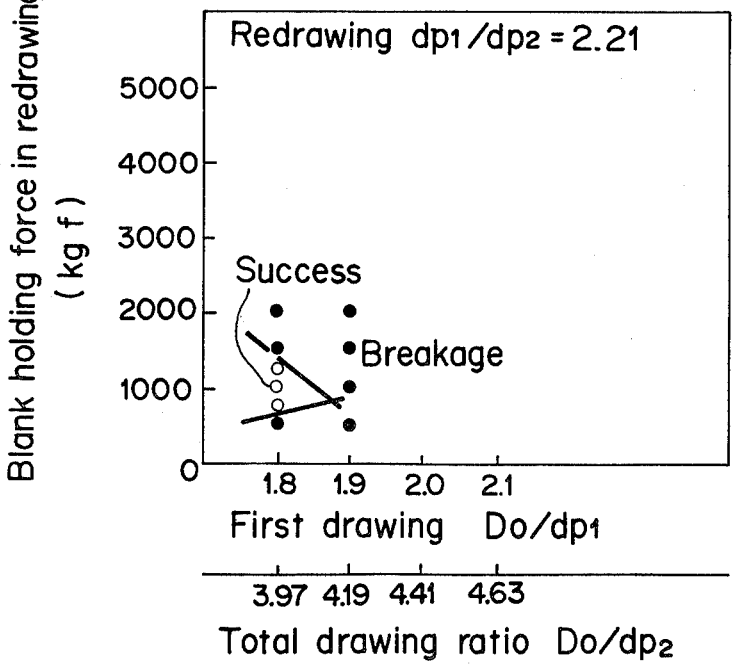

Consequently, the forming circumstances at the redrawing ratio $dp_1/dp_2$ being 2.08 are shown in FIG. 29, and those of the drawing ratio being 2.21 are shown in FIG. 30.

As is seen from FIGS. 29 and 30, when the reverse redrawing is performed with the hydraulic counterpressure, the redrawing ratio is improved up to around 2.2 and the total drawing ratio $Do/dp_2$ is improved around 4.0 to 4.2 in comparison with the conventiona metal molding process. However this comparative process is low in the improvement of the redrawing ratio in comparison with the present invention which adds the radial pressure.

Such difference arises because the comparative process only has the friction-keeping-effect by the counterpressure and the lubrication on one side of the first drawn product, and therefore the breakage at the shoulder of the redrawing punch or the breakage at the die shoulder (punch hole in the first drawing process) are easily created. On the other hand, the present invention has the synergestic effect of pushing effect to the side wall of the first drawn product by the radial pressure and the friction-reducing-effect by the lubricant to the both sides of the first drawn product, in addition to said effect of the comparative pressure. Thus the breakage is difficult to appear and the redrawing ratio and the total drawing ratio are improved.

The above statement refer to several embodiments of the invention, and other variations would be employed within the technical idea of the invention.

What is claimed is:

1. Metal sheet forming process with hydraulic counterpressure which forms a blankpiece into a determined shape by means of a die having a hydraulic pressure chamber which is filled with liquid, a blank holder positioned in opposition to said chamber, and a punch to be urged into the pressure chamber, an improvement comprising forming a ring-like space between the die and the blankholder to close the outer circumference of the blankpiece, moving down the punch such that the blankpiece is drawn into the hydraulic pressure chamber, thereby to generate hydraulic counterpressure, supplying part of the generated counterpressure into the ring-like space via bypath passage from the pressure chamber, whereby compression force in radial direction is added to the outer circumference of the blankpiece by said supplied hydraulic pressure, and making fluid lubrication on both surfaces of the blankpiece during the above procedures.

2. A process as claimed in claim 1, wherein a blank holding is a stationary blank holding process.

3. A process as claimed in claim 1, wherein a blank holding is a pressure blank holding process.

4. A process as claimed in claim 1, causing the part of the hydraulic counterpressure generated in the pressure chamber by drawing the blankpiece to act as compression force from the outer circumference of the blankpiece through the bypath passages communicating the hydraulic pressure chamber and the ring-like space, and supplying the hydraulic counterpressure through other bypath passages to provide counterpressure including ironing component.

5. A process as claimed in claim 1, wherein the blankpiece includes a plate material and a cup shaped body by first drawing from the plate material.

6. A process as claimed in claim 1, wherein the forming is carried out at a ring-like space of 1.02 to 1.20 times of thicknecc of the material.

7. A metal sheet forming process with hydraulic counterpressure, comprising mounting a blankpiece on a punch which serves also as a redrawing die formed with a hydraulic pressure chamber in an axial direction and a blank holder of cushion type which is an outer circumference of the punch, undertaking cushion drawing by means of the blank holder, a first drawing die in opposition and said punch, supplying the hydraulic counterpressure within the pressure chamber to a ring-like space between the punch and the first drawing die through bypath passages running through the side wall of the punch, while urging the redrawing punch into said hydraulic pressure chamber, and carrying out pushing of the side wall of the first drawn product to the axial direction and lubrication on the both surfaces of the blankpiece by means of the hydraulic counterpressure supplied into said space till drawing reaches determined depth.

8. A process as claimed in claim 7, wherein the pressure of the hydraulic pressure chamber in the reverse redrawing is a forcible pressure increasing process.

9. A process as claimed in claim 7, wherein the pressure of the hydraulic pressure chamber in the reverse redrawing process is a natural pressure increasing process by pushing the punch.

10. A process as claimed in claim 7, wherein the forming is carried out at a ring-like space of 1.0 to 1.20 times of thickness of a first drawn material.

* * * * *